US005170875A

United States Patent [19]

Kubota

[11] Patent Number: 5,170,875

[45] Date of Patent: Dec. 15, 1992

[54] CONVEYOR MACHINE

[76] Inventor: Masao Kubota, 22-7, Narimasu 2-chome, Itabashi-ku Tokyo, 175, Japan

[21] Appl. No.: 684,940

[22] PCT Filed: Sep. 7, 1990

[86] PCT No.: PCT/JP90/01150

§ 371 Date: May 1, 1991

§ 102(e) Date: May 1, 1991

[87] PCT Pub. No.: WO91/03417

PCT Pub. Date: Mar. 21, 1991

[30] Foreign Application Priority Data

| | | | |
|---|---|---|---|
| Sep. 7, 1989 | [JP] | Japan | 1-230458 |
| Sep. 20, 1989 | [JP] | Japan | 1-241770 |
| Jan. 29, 1990 | [JP] | Japan | 2-16070 |

[51] Int. Cl.[5] ..... B66B 21/00

[52] U.S. Cl. ..... 198/328; 198/332

[58] Field of Search ..... 198/328, 332, 333, 852, 198/337

[56] References Cited

U.S. PATENT DOCUMENTS

| | | | |
|---|---|---|---|
| 727,720 | 5/1903 | Venn | 198/328 |
| 984,495 | 2/1911 | Seeberger | 198/328 |
| 984,858 | 2/1911 | Seeberger | 198/328 |
| 1,130,556 | 3/1915 | Wheeler | 198/328 |
| 3,395,648 | 8/1968 | Karr et al. | 198/328 |
| 3,489,260 | 1/1970 | Hara et al. | 198/328 |

FOREIGN PATENT DOCUMENTS 2031903 8/1979 Fed. Rep. of Germany ..... 198/337

*Primary Examiner*—Joseph E. Valenza

*Attorney, Agent, or Firm*—Staas & Halsey

[57] ABSTRACT

A conveyer machine which has a forward conveyer part and a backward conveyer part continuous therewith, and which is simple in construction, small in size, and light in weight, and which can be applied to various fields. A reciprocal escalator serving as the conveyer machine comprises a plurality of steps which are closely disposed on looped guide rails disposed along a travel motion path including a forward section and a backward section which are continuous with each other through turning sections. Adjacent steps are coupled to each other by a parallel link mechanism having coupling nodes each of which has opposite ends thereof lockably coupled to pin node points provided at columns of these steps and each of which is bendable around a pin disposed at the middle of the coupling node, so that these steps are enabled to smoothly travel around the travel motion part which includes ascent and descent sections and curved sections. The conveyor machine, which permits reciprocal transfer, which has freedom in setting the travel motion path, and which is simple, light and compact, is free from limitations in installation and execution, and hence can be applied to various fields.

16 Claims, 19 Drawing Sheets

CONVEYOR MACHINE

BACKGROUND OF THE INVENTION

1. Technical Field

The present invention relates to a conveyer machine serving as, e.g., an escalator, a moving footpath, or a goods-assorting apparatus installed in buildings, terminals, footbridges, outdoor works or the like, and more particularly, to a conveyer machine having a forward conveyer part and a backward conveyer part continuous therewith.

2. Background Art

Conventionally, various conveyer machines are employed for transportation of passengers and goods. For instance, an escalator for conveying passengers from a lower or upper floor to an upper or lower floor is known. The conventional escalator comprises a plurality of steps which are connected to left and right endless chains each stretched between upper and lower sprocket wheels disposed at the upper and lower floors, and which are supported by left and right guide rails each formed into a loop-shape as viewed in a vertical plane. The endless chains are circularly moved around the sprocket wheels with rotation of these wheels, to cause the steps which the passengers get on and off to move from the lower or upper floor to the upper or lower floor along upper rail portions of the guide rails. Each step is inverted when it reaches the upper or lower floor, and then is moved back to the lower or upper floor along lower rail portions of the guide rails, with the step kept inverted.

According to this arrangement wherein the steps are inverted during the backward movement, it is inevitably necessary to provide an escalator for transportation from the lower floor to the upper floor and another escalator for transportation from the upper floor to the lower floor separately and independently from each other. Further, in the inverted section, the steps cannot be utilized for transportation. This is inefficient.

Moreover, the conventional escalator is heavy in weight, and is hence limited in utilization. Usually, the conventional escalator of a type where each step permits one passenger to ride thereon has a step width of approximately 500 mm, and the escalator whose step permits two passengers to ride thereon has a step width of approximately 1,000 mm. The two passenger type escalator has its entire width of approximately 1,200 mm, including the width of moving handrails. Thus, if an installation space is small, it is impossible to install even an ascent escalator together with a descent staircase, and hence both of ascent and descent escalators cannot be installed.

A moving footpath for horizontally conveying passengers is also known. However, the conventional moving footpath has the same drawbacks as those encountered in the conventional escalator. In particular, it is required to provide both a moving footpath for transportation from a first position to a second position and another moving footpath for transportation from the second position to the first position separately and independently from each other.

Disclosure of the Invention

The object of the present invention is to provide a conveyer machine which has a forward conveyer part and a backward conveyer part continuous therewith, and which is simple in construction, small in size, and light in weight, and which can be applied to various fields.

In order to achieve the above-mentioned object, the conveyer machine of the present invention comprises: a travel motion path including a forward section and a backward section which are continuous with each other through a turning section; a plurality of steps disposed on the travel motion path and each having a step face member; link means each coupling a corresponding pair of steps to each other; means for maintaining the step face member of each step horizontal; and a drive mechanism for driving the plurality of the steps, each link means being bendable around a first axis perpendicular to a traveling direction of an associated one pair of steps and around a second axis perpendicular to both the step traveling direction and the first axis.

As mentioned above, according to the present invention, the plurality of steps is disposed on the travel motion path including the forward and backward sections which are continuous with each other through the turning section, and these steps are driven to move along the travel motion path. This makes it possible to provide the conveyer machine with a single unified system including the forward conveyer part achieved by those steps which travel along the forward section and the backward conveyer part achieved by those steps which travel along the backward section. Moreover, since the adjacent steps are coupled to each other by the link means bendable around the two axes perpendicular to the traveling direction of these steps and perpendicular to each other, and the step face members are kept horizontal by the link means, it is possible to cause the steps to smoothly move along the travel motion path including ascent, descent, and curved sections.

In addition to the above-mentioned features such that the reciprocal transportation is achieved and that the freedom in setting the travel motion path is high, the conveyer machine of the present invention is simple in construction, small in size, and light in weight. Therefore, the conveyer machine of the invention has only slight limitations in installation and execution, so that the machine can be applied to various fields. For instance, a reciprocal escalator can be provided, which can be installed in an existing staircase or a narrow passage at an underground railway station, a footbridge or the like, with slight conversion. Old persons and sick persons are released from labor at staircases of footpath bridges and public buildings such as a railway station, and from danger of falling therefrom. Utilization of the footpath bridges shunned by persons is enhanced, to thereby contribute to traffic safety. Sights of buildings and sight-seeing facilities are improved by the use of graceful curved travel motion paths. Working efficiency at goodsassorting terminals is improved. Further, a moving footpath with slopes and curves can be provided.

DESCRIPTION OF THE PREFERRED EMBODIMENTS

In the following, an escalator according to a first embodiment of the present invention will be explained.

Whole arrangement

Figure 1:
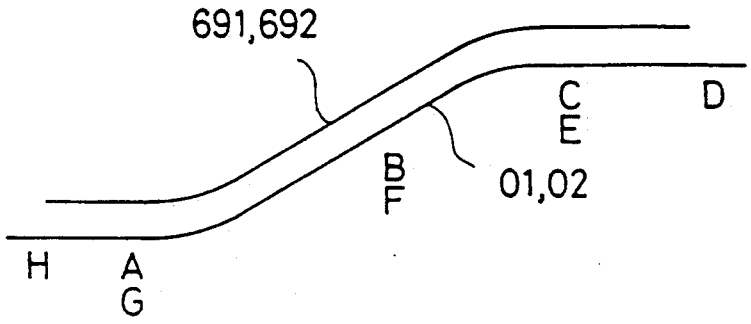
FIG. 1 is a schematic side view showing a travel motion path of an escalator according to a first embodiment of the present invention, together with guide rails for steps and for a moving handrail.
Figure 2:
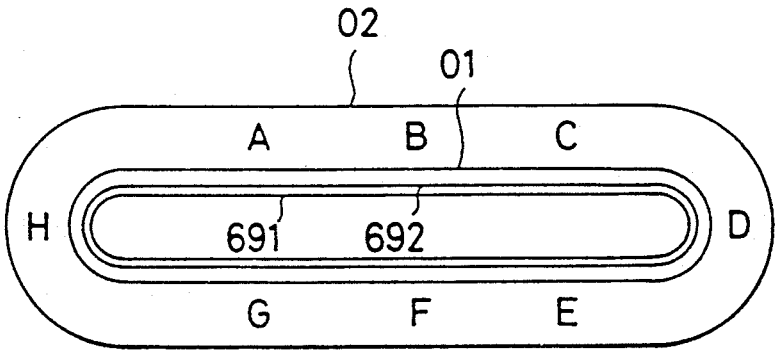
FIG. 2 is a schematic plan view of the escalator shown in FIG. 1.

Referring to FIGS. 1 and 2, the escalator is designed to transport a plurality of steps (not shown), which passengers get on and off, along a travel motion path A through G. The travel motion path includes a forward section which consists of a horizontal straight traveling section A for a lower floor, an ascent straight section B obliquely upwardly extending from the lower floor to an upper floor, and a horizontal straight traveling section C for the upper floor; and a backward section which consists of a horizontal straight traveling section E for the upper floor, a descent straight section F obliquely extending downwardly from the upper floor to the lower floor, and a horizontal straight traveling section G for the lower floor. The forward section A through C is continuous with the backward section E through G through a turning section D for the upper floor in which the traveling direction of the steps gradually changes, and the backward section is continuous with the forward section through a turning section H for the lower floor. Namely, the escalator is arranged to achieve both the functions of forward and backward escalators by a single unified system which is, as a whole, formed into a loop.

Figure 3:
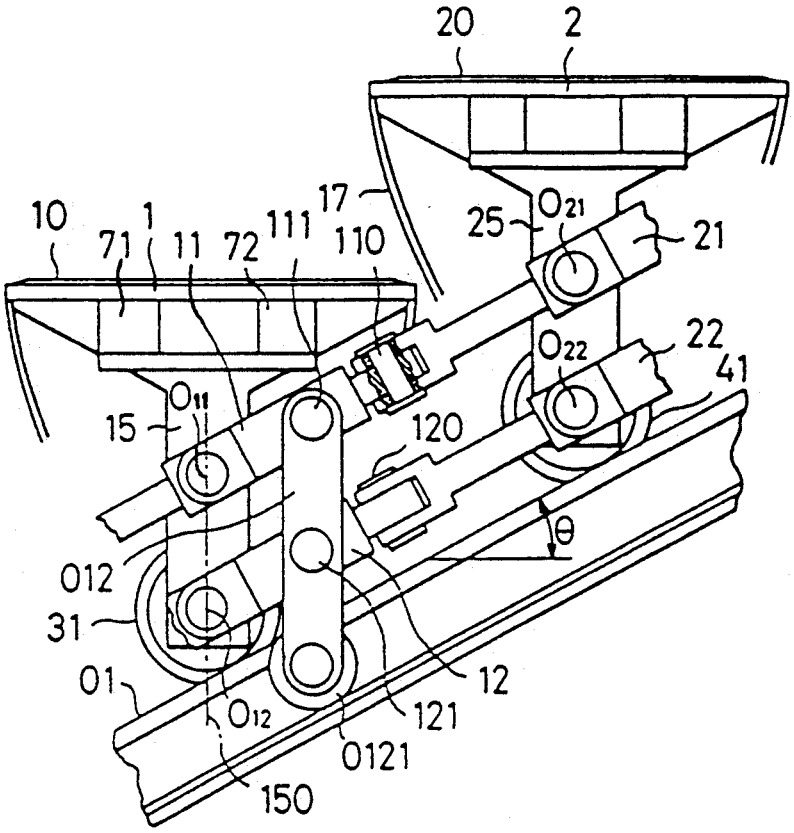
FIG. 3 is a side view showing steps and a parallel link mechanism.
Figure 3A:
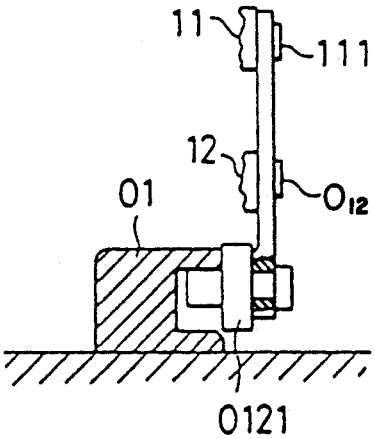
FIG. 3*a* is a front view, partly in cross section, showing a mechanism for preventing disengagement from a rail.

The escalator comprises inner and outer main guide rails 01, 02 (FIGS. 1 through 4) respectively extending along inner and outer peripheries of the escalator, a plurality of steps (two of which are shown by reference numerals 1 and 2 in FIG. 3) disposed on these guide rails, and a drive mechanism (FIGS. 6 and 7) for driving the steps. The driving force applied to some of the steps by the drive mechanism is sequentially transmitted to all the steps through these steps abutted to each other, so as to enable all the steps to perform horizontal travel motion, ascent and descent travel motion (oblique travel motion), and turning travel motion along the travel motion path A through H.

The escalator of the present embodiment further comprises parallel link mechanisms (FIG. 3) each coupling a corresponding one pair of adjacent steps to each other, a moving handrail (FIG. 1, FIG. 8 and FIG. 10), a handrail drive mechanism (FIG. 9), and an expansion/contraction joint mechanism (FIG. 2*a*) for adjusting the lengths of the main guide rails. The rail lengths are adjusted by the expansion/contraction joint mechanism to eliminate step size errors, whereby the steps are brought into close contact with one another, to permit the above-mentioned step driving force to be smoothly sequentially transmitted. Preferably, the step drive mechanism and the handrail drive mechanism are provided at one of the turning sections. In FIGS. 1 and 2, reference numerals 691 and 692 designate guide rails (mentioned later) for the moving handrail.

Steps

Each of the steps, e.g., the step 1 has its step face member 10 which passengers get on and off, and the step face member is formed at its opposite ends with horizontal guide faces 13. During the horizontal travel motion of the step 1, these horizontal guide faces 13 are slidably engaged with horizontal guide faces 14 provided in a floor 9 which corresponds to the horizontal traveling sections A, C, E and G, so that the step face member 10 is maintained to be horizontal.

Figure 4:
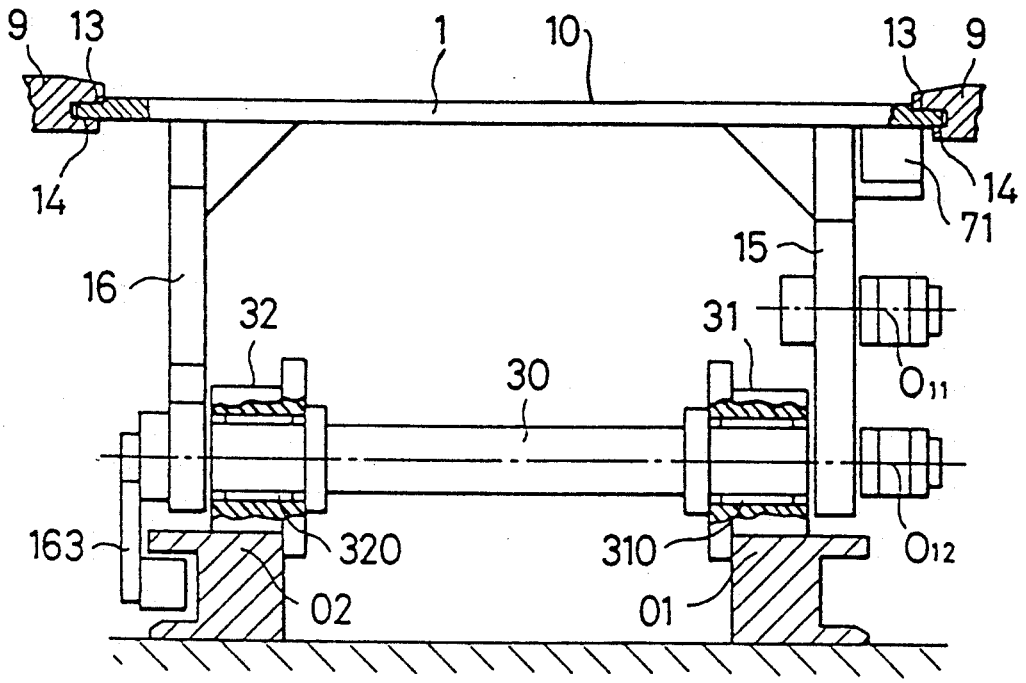
FIG. 4 is a front view, partly in cross section, showing a step.
Figure 4A:
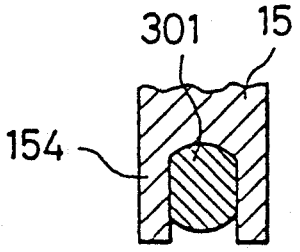
FIG. 4*a* is a fragmentary sectional side view showing a lower end portion of a main column of the step.
Figure 4B:
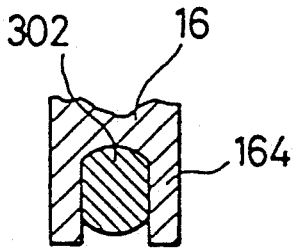
FIG. 4*b* is a view, similar to FIG. 4*a*, showing a lower end portion of an auxiliary column of the step.

The step 1 has a main column 15 and an auxiliary column 16 which vertically downwardly extend along axis 150 from opposite end portions of the step face member 10, respectively, a wheel shaft 30 supported by these columns, and wheels 31, 32 supported by the wheel shaft and disposed on the main guide rails 01, 02 for travel motion. The wheel shaft 30 is formed at its opposite ends with flattened portions 301 and 302, and lower ends 154 and 164 (FIGS. 4*a* and 4*b*) of both the columns are formed into a fork-shape, respectively. The flattened wheel shaft portions 301 and 302 are individually fitted to the lower column ends 154 and 164, so that the wheel shaft 30 is unrotatable relative to the columns 15 and 16. The wheels 31 and 32 are rotatably supported by the wheel shaft 30 through needle roller bearings 310 and 320.

Figure 5:
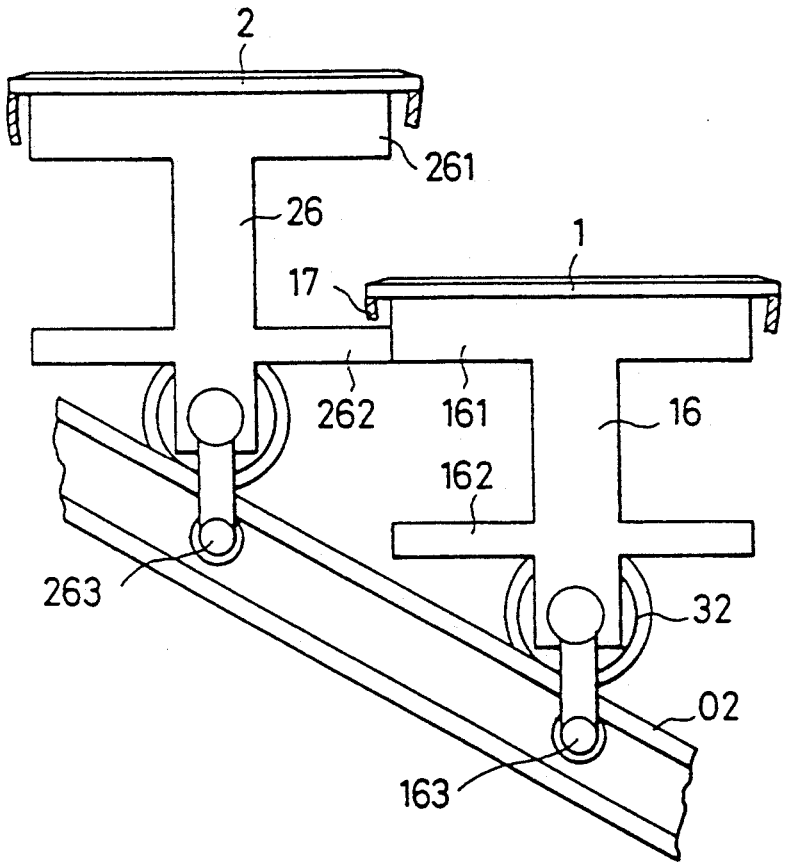
FIG. 5 is a side view showing auxiliary columns.

As shown in FIG. 5, the auxiliary column 16 of the step 1 is integrally formed at its upper end portion with an upper protuberance 161 extending horizontally along the step face member 10, and is integrally formed at its intermediate portion with a lower protuberance 162 extending in parallel to the upper protuberance 161. A step 2 has a step face 20 and an auxiliary column 26 formed with similar upper and lower protuberances 261 and 262. Reference numeral 17 designates a riser or skirt having a retractable bottom, and 163 and 263 denote levers for preventing the steps 1 and 2 from floating.

The vertical distance between the upper and lower protuberances depends on an inclined angle of the oblique section of the travel motion path, so that the upper protuberance of an adjacent step which is located at a vertically lower level is brought into contact with the lower protuberance of the step located at an upper level at their opposed end faces during the oblique travel motion of these steps. During the horizontal travel motion, the adjacent steps are brought into urged contact with each other at opposed end faces of their step face members. With this arrangement, a feedback action is achieved to prevent a zig-zag motion of the steps.

Figure 5A:
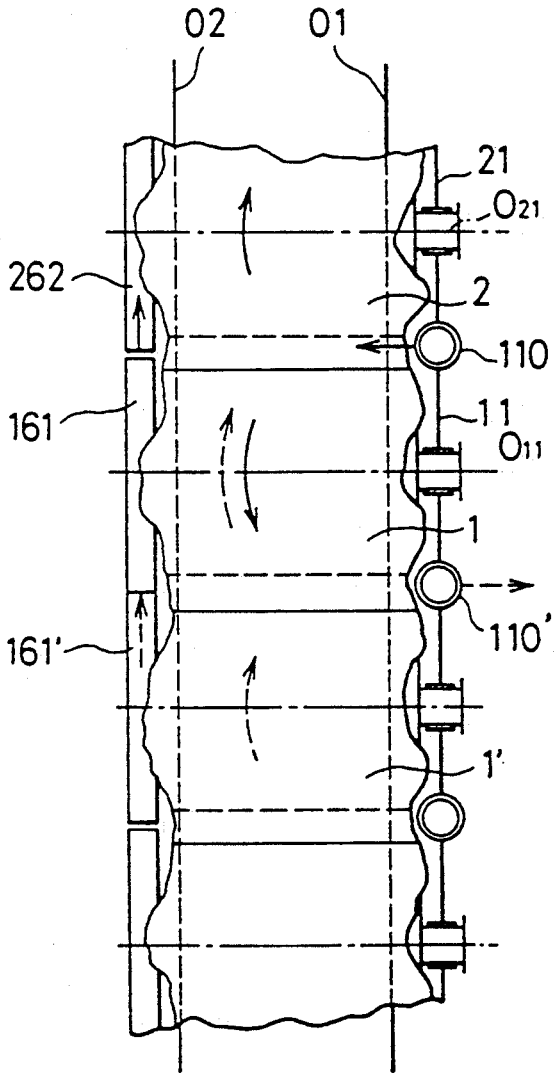
FIG. 5*a* is a plan view showing a feedback action performed during oblique travel motion.

For example, during the ascent travel motion shown in FIG. 5, when the step 1 is inclined down to the left as shown by the solid arrow in FIG. 5*a* (when the left end of the step retreats), a pin 110 of the parallel link mechanism associated with the steps 1 and 2 is displaced to the left. As a result, the step 2 which is vertically higher than the step 1 is inclined to the left in FIG. 5*a*, so that the upper protuberance 161 of the step 1 is moved away from the lower protuberance 262 of the step 2. At the same time, a pin 110' of the parallel link mechanism associated with the step 1 and a step 1' located at a vertically lower level is displaced to the right, to thereby cause the step 1' to be inclined up to the left, so that an upper protuberance 161' of the step 1' depresses the lower protuberance 162 of the step 1, to depress the step 1 to the left as shown by a dotted arrow, thereby moving the step to its original position.

If the steps are formed into a rectangular shape as viewed from the above, these steps interfere at their inner portions with each other during the turning travel motion. To avoid this, in the present embodiment, the inner portion of each step is obliquely cut off (FIG. 6), so that the inner portions 132, 231 of adjacent steps (e.g. 1 and 23) are in contact with or close to each other during the turning travel motion. In the turning sections D and H, the steps get under the floor. Hence, a gap defined between outer portions of the adjacent steps during their turning travel motion is never seen by the passengers, so that no inconveniences will occur.

Parallel link mechanisms

Each of parallel link mechanisms connects a corresponding one pair of steps. For instance, the parallel link mechanism associated with the steps 1 and 2 comprises coupling nodes 11 and 12, i.e., links $\overline{O_{11}O_{21}}$ and $\overline{O_{12}O_{22}}$, extending in parallel to each other at locations above the inner main guide rail 01. The coupling node 11 has two link halves which are coupled to each other at an intermediate portion of the node by the pin 110, extending perpendicular to the link axis, in such a manner that the link halves are bendable around the pin. The opposite ends of one of the link halves are respectively coupled to the pin 110 and the pin node $O_{11}$ which is provided in the main column 15 of the step 1, whereas the opposite ends of the other link half are respectively coupled to the pin 110 and a pin node $O_{21}$ provided at the main column 25 of the step 2. Similarly, the coupling node 12, which consists of two link halves coupled to each other by a pin 120 in a manner bendable therearound, has opposite ends thereof respectively coupled to pin nodes $O_{12}$ and $O_{22}$ provided in the main columns 15 and 25.

That is, the coupling nodes 11 and 12 associated with the steps 1 and 2 are designed to be bendable around the two axes perpendicular to each other and each perpendicular to the step traveling direction. Accordingly, during the oblique travel motion, the coupling nodes 11 and 12 are swung in the vertical plane around the horizontal axes (pin nodes) to permit the steps 1 and 2 to assume different vertical positions, whereas, these coupling nodes are swung in the horizontal plane around the vertical axes (pins 110, 120) during the turning travel motion, to permit the steps to travel in different directions. This enables the steps to smoothly travel along the main guide rails 01 and 02 over the entire travel motion path.

Further, the parallel link mechanism has a coupling node 012 which is coupled to the coupling nodes 11 and 12 through pins 111 and 121, and which has a lower extension having a lower end thereof provided with a stepped rotary contact 0121. This rotary contact 0121 is fitted in a groove formed at a side face of the inner main guide rail 01, thereby preventing the steps 1 and 2 from being disengaged (floated and zigzagged) from the guide rails 01 and 02.

According to the disengagement preventing function of the parallel link mechanisms, the aforesaid structural feature of the steps, and the aforesaid feature of closely arranging the steps on the guide rails, the steps are always brought into close contact with the guide rails, with their main and auxiliary columns always kept vertical, whereby the step face members are always maintained horizontal. More specifically, in the horizontal traveling sections, the step face members of the steps are maintained horizontal by the horizontal guide faces 14 of the floor 9. As long as the step face members of those steps which belong to the horizontal traveling sections are maintained horizontal, the step face members of those steps which belong to the other sections are also naturally maintained horizontal because the steps are closely disposed over the entire travel motion path. Additionally, in the ascent and descent travel motion sections, associated ones of the upper and lower protuberances of adjacent steps are brought into contact with each other to maintain the columns of these steps to be vertical, and these steps are prevented from being disengaged from the guide rails. As a consequence, the horizontality of the step face members are ensured over the whole of the travel motion path.

Expansion/contraction joint mechanism

Figure 2A:
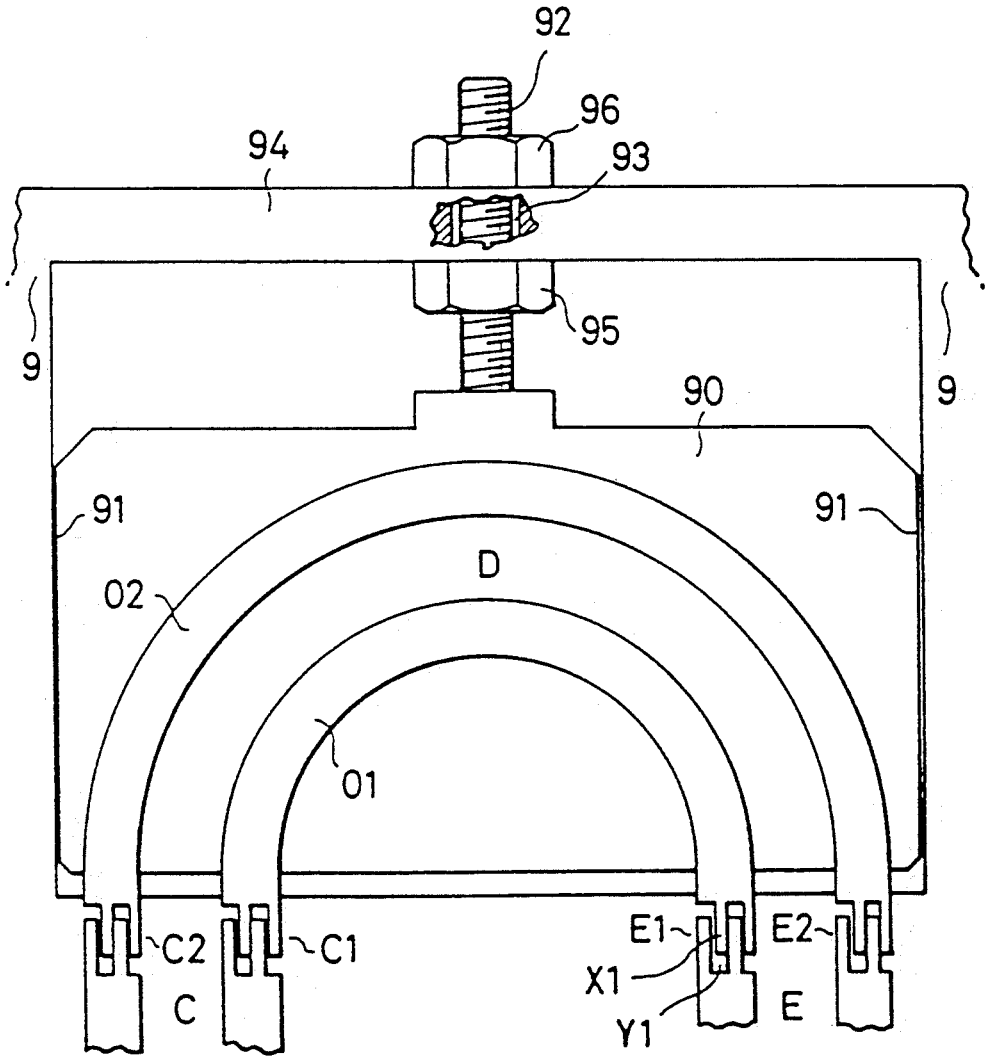
FIG. 2*a* is a plan view showing an expansion and contraction joint mechanism.

An expansion/contraction joint mechanism for adjusting rail lengths is provided in that turning section, e.g., the turning section D, in which no drive mechanism is disposed. As shown in FIG. 2*a*, the expansion/-contraction joint mechanism comprises a rail floor 90 on which U-shaped guide rails corresponding to the turning section D is mounted, and which is arranged for horizontal movement along guide faces 91 provided in the floor 9. A screw 92 fixed to an outer end of the rail floor 90 extends through a through hole 93 formed in a stationary horizontal beam 94 which is disposed perpendicular to the axis of the screw. The screw 92 is threadedly engaged with a pair of lock nuts 95 and 96 between which the beam 94 is held.

The opposite ends of the U-shaped portions of guide rails 01 and 02 corresponding to the turning section D, and opposed ends of the straight portions of the guide rails 01 and 02 corresponding to the horizontal sections C and E are respectively formed into a comb-like shape, and a tooth X1 formed in each rail end is movable toward and away from a groove Y1 formed in a corresponding rail end within the groove. That is, these rail ends form rail joints $C_1$, $C_2$, $E_1$, and $E_2$. By rotating one of the lock nuts 95 and 96, with the other nut unlocked, the rail floor 90 and the U-shaped guide rails mounted thereon are moved toward and away from the straight guide rails, whereby the total lengths of the guide rails are increased and decreased. After the guide rail lengths are adjusted in such a manner that the steps are closely disposed on the guide rails, the lock nuts 95 and 96 are locked, to thereby fix the rail floor 90. Since no passenger load is applied to the guide rails 01 and 02 at their joint-formed portions, no difficulties are encountered even if the guide rails are formed with the joints $C_1$, $C_2$, $E_1$ and $E_2$ each providing a small effective load sustaining area. Although the total length of all the coupled steps slightly varies during their travel motion, this length variation is absorbed by deformation of the horizontal beam, expansion/contraction of the coupling node of the respective parallel link, and change in the magnitude of a gap defined in the respective pin bearing. At that time, the links are well resistant to load exerted thereon. In the meantime, the load sometimes exerts a tensile force at an upper location while most of the load exerts a compression force.

Step Drive Mechanism

Figure 6:
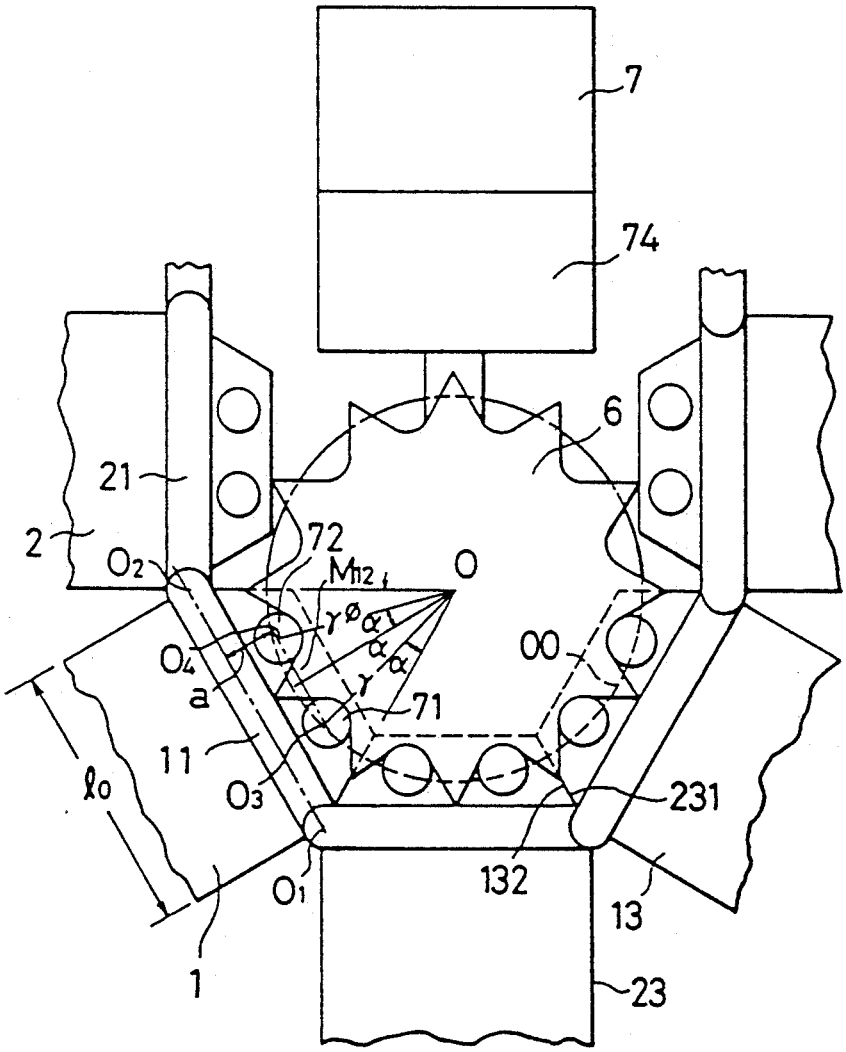
FIG. 6 is a plan view showing a step drive mechanism.
Figure 7:
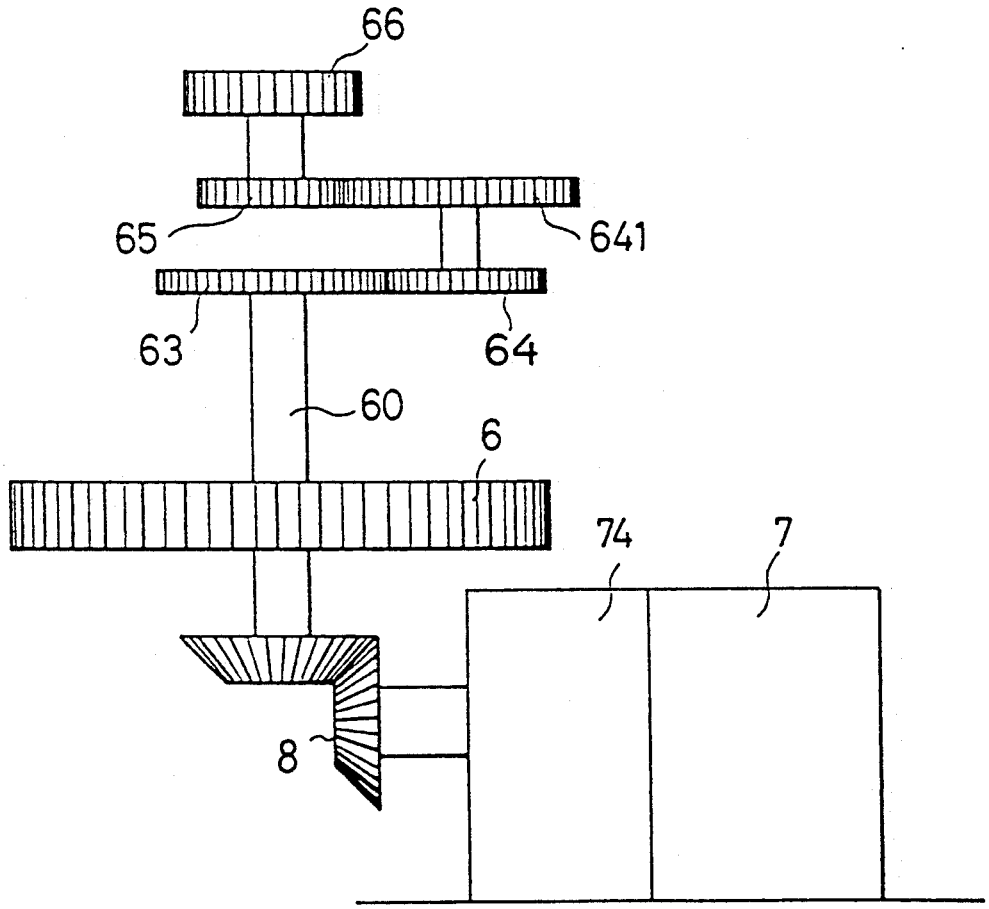
FIG. 7 is a view showing a drive system of the step drive mechanism and of a moving handrail drive mechanism.

As shown in FIGS. 6 and 7, the step drive mechanism comprises a spur gear 6 which is in mesh with pin-like teeth 71 and 72 provided in each of the steps, and which is coupled to an electric motor 7 through a bevel gear 8 and a speed reducer 74. The spur gear 6 is comprised of, e.g., a sprocket gear whose root is formed into a concave arc tooth.

When the steps are disposed in close contact with one another over the entire region of the travel motion path A through H or most of the traveling sections for the lower floor, forces applied to each step from the adjacent steps are balanced to each other in the turning section H for the lower floor, as in the case of a water pump which is provided at the bottom of a U-shaped tube filled with water. In this case, a force required for driving all the steps is equal to the algebraic sum of friction resistance produced with the travel motion of all the steps and a value which is approximately sin $\theta$ times the difference between the total weight of the passengers in the ascent section and that in the descent section. The symbol $\theta$ represents the inclined angle of the guide rails. Therefore, it is possible to cause the steps to travel with a relatively small driving force.

In order that the teeth of the spur gear 6 are disposed at equal pitch intervals when the pitch of the spur gear 6 is represented by a circle 00 (FIG. 6) whose center is coincident with the curvature center O of the guide rail concerned, the following formula in connection with the triangle $\Delta OO_1M_{12}$ must be fulfilled, the triangle being obtained by connecting the guide rail curvature center O, the pin center $O_1$ and the midpoint $M_{12}$ of the straight line which connects the center $0_1$ of the pin 110 with the center $O_2$ of the pin 120, these pins being associated with the coupling nodes 11 and 12 of the step concerned.

$$a + r\cos\alpha = (l_0/2)\cot 2\alpha.$$

By rearranging this, we obtain $$r = [(l_0/2)\cot 2\alpha - a]\sec\alpha$$

where r represents the radius of the pitch circle OO of the spur gear 6 passing through the centers $O_3$, $O_4$ of the pin-like teeth 71, 72 of the step; $l_0$, the distance $\overline{O_1O_2}$; $\alpha$, the angle $\angle O_1OO_3 (= 180°/z$ (z represents the number of teeth of the spur gear 6)); and a, the distance between the straight lines $\overline{O_1O_2}$ and $\overline{O_3O_4}$.

Moving Handrail

A moving handrail is provided over the whole of the travel motion path, to ensure the safety of the passengers. The moving handrail is disposed at one side of the travel motion path substantially along the inner guide rail 01, and is formed into a chain comprised of a plurality of short handrail units 5 (FIG. 8), adjacent ones of these units being coupled to each other by means of an associated universal coupling. Each universal coupling is bendable around two directions perpendicular to the handrail moving direction and perpendicular to each other, whereby the moving handrail can be smoothly circulated along the travel motion path which includes ascent, descent and turning sections.

Figure 8:
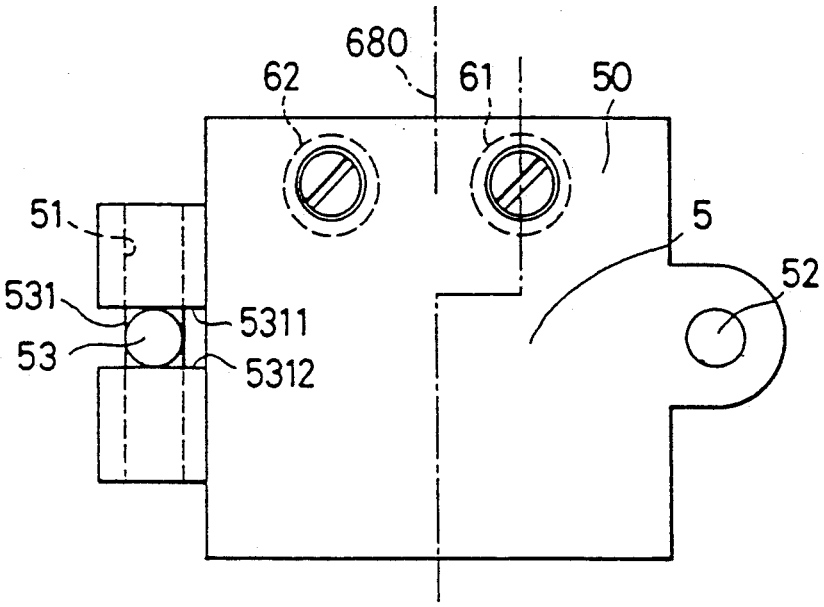
FIG. 8 is a plan view showing a moving handrail unit.
Figure 8A:
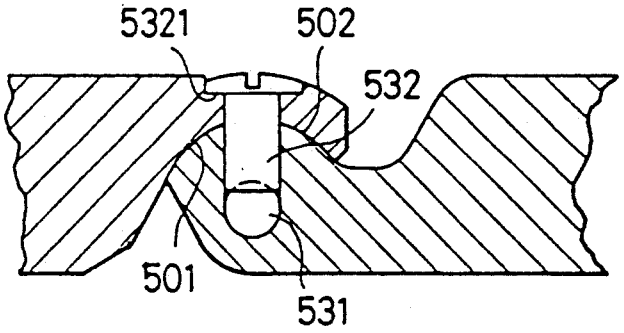
FIG. 8*a* is a fragmentary section view showing a coupling part of adjacent handrail units.

As shown in FIG. 8, each of the handrail units 5 has one end (left end in the figure relative to the axis 680) formed with a horizontal bore 51 perpendicular to the handrail unit traveling direction, and another end (right end in the figure) formed at the upper face 50 of the handrail with a vertical bore 52. Adjacent handrail units 5 are coupled to each other by means of a T-shaped pin 53 which is fitted in the horizontal bore 51 of one of these units and the vertical bore 52 of the other unit. A vertical shaft 532 of the T-shaped pin is abutted to those end faces 5311 and 5312 of the handrail unit 5 at which the horizontal bore is formed, whereby a horizontal shaft 531 of the T-shaped pin is prevented from being horizontally moved. Further, the vertical shaft 532 of the T-shaped pin is formed with a collar 5321, so that the pin is prevented from being vertically disengaged. As shown in FIG. 8*a*, adjacent ones of the handrail units are in contact at their spherical faces 501 and 502 with each other for swivel motion. Thus, the adjacent handrail units are bent from other around the horizontal shaft 531 when transition is made between their oblique traveling and horizontal traveling, and are bent around the vertical shaft 532 during the turning travel motion.

Handrail drive mechanism

Figure 9:
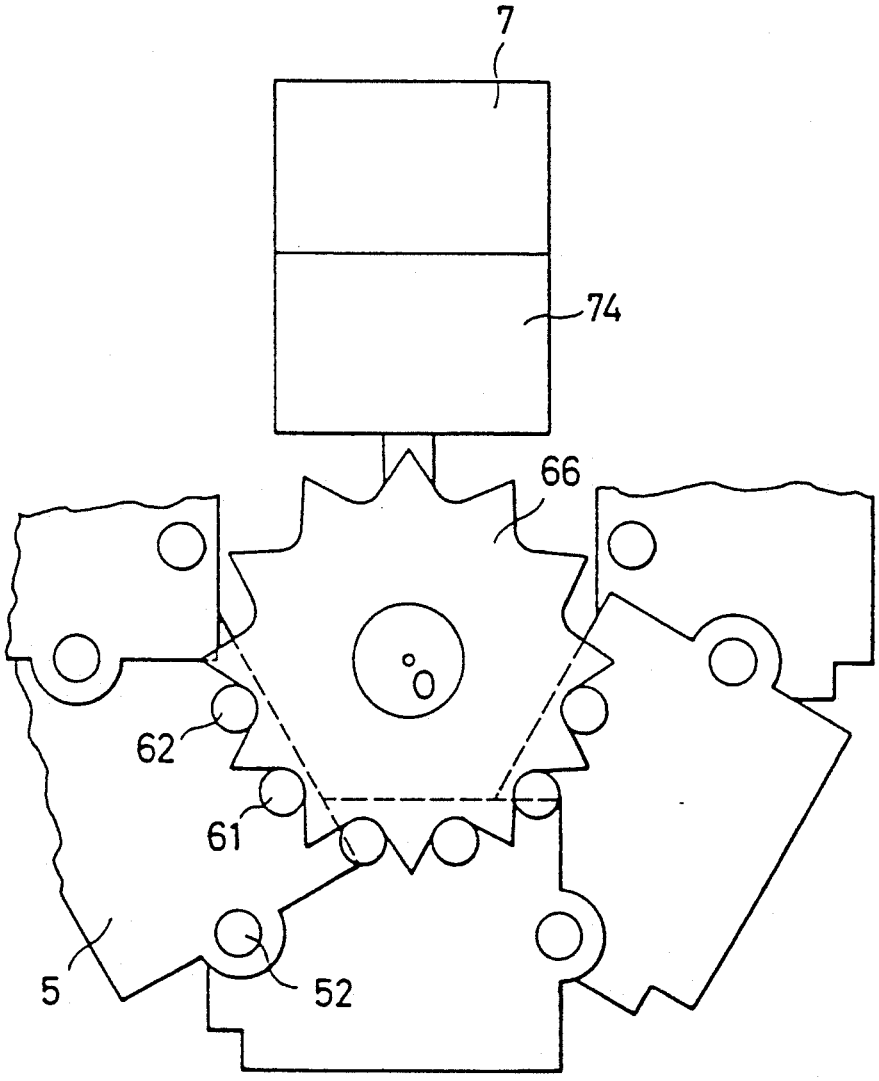
FIG. 9 is a plan view of the moving handrail drive mechanism.
Figure 10:
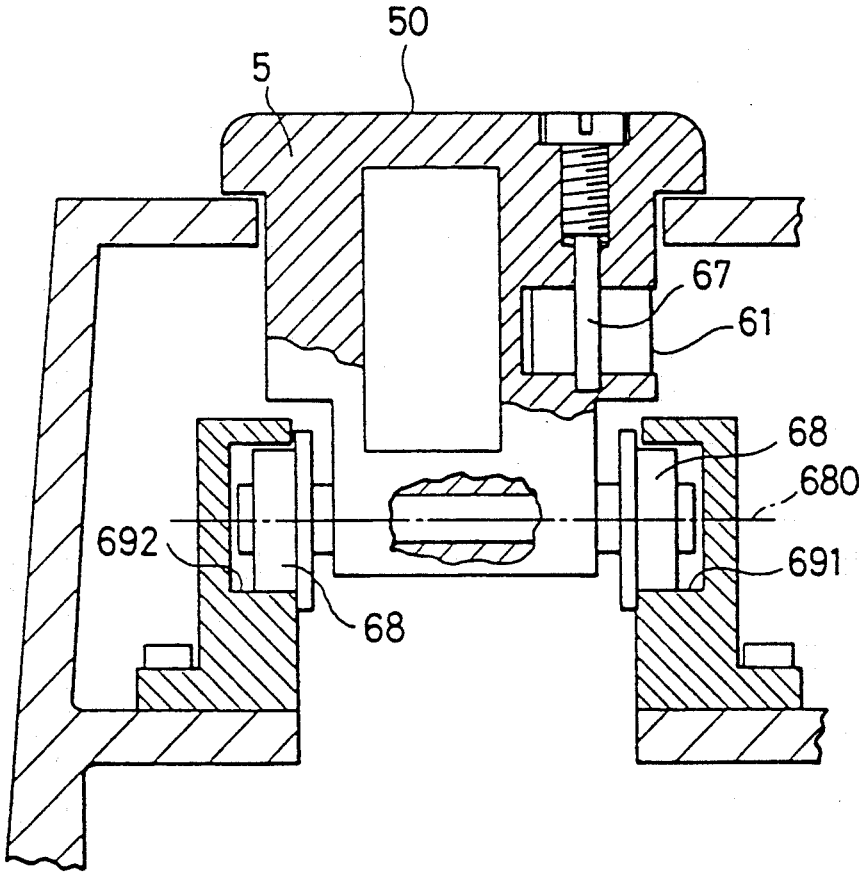
FIG. 10 is a fragmentary sectional view showing the handrail unit and its drive mechanism.

Referring to FIG. 9, a handrail drive mechanism comprises a drive gear 66 which is in mesh with the pin-like teeth 61 and 62 provided in the respective handrail unit 5. As shown in FIG. 7, the drive gear 66 is operatively coupled to a shaft 60 of the spur gear 6 through a pinion gear 65, which is rotatable in unison with the drive gear, intermediate gears 641 and 64, and a gear wheel 63. In FIG. 10, reference numeral 67 denotes a pin-like tooth mandrel for supporting the pin-like teeth 61 of the handrail unit 5; 68, a handrail mounting wheel; and 691 and 692, guide rails for the moving handrail.

The curvature radii of the handrail guide rails 691 and 692 in the turning section are set to be less than those of the step guide rails 01 and 02. In this connection, the pitch circle radius of the drive gear of the handrail unit is set to be smaller than that of the step drive gear, and the rotation rate of the drive gear 66, driven by the motor 7 which is common to the drive gear and the step drive mechanism, is adjusted to a proper rate by means of the aforementioned gear mechanism 63 to 65, whereby the moving handrail travels at the same speed as the traveling speed of the steps.

Meanwhile, it is not inevitably necessary to dispose the handrail drive gear 66 in such a manner that its shaft is aligned with the step drive shaft 60. Alternatively, the handrail drive shaft may be driven by the step drive shaft through a chain or a toothed belt.

Further, the travel motion path may be provided at each side thereof with the moving handrail, to improve the safeness. In this case, a circular moving handrail comprised of either the conventional moving handrail or the foregoing handrail units 5 may be provided at the outer side of the travel motion path. If the outer moving handrail is provided, the handrail may be designed to get under the floor at that location at which the steps get under the floor, so as to eliminate difficulties which would otherwise occur when the passengers get on and off the escalator. Further, an outer moving handrail drive gear may be operatively coupled to the drive shaft of the inner moving handrail drive gear through a chain or gear transmission mechanism.

Next, an escalator of a second embodiment of the invention will be explained.

Figure 13:
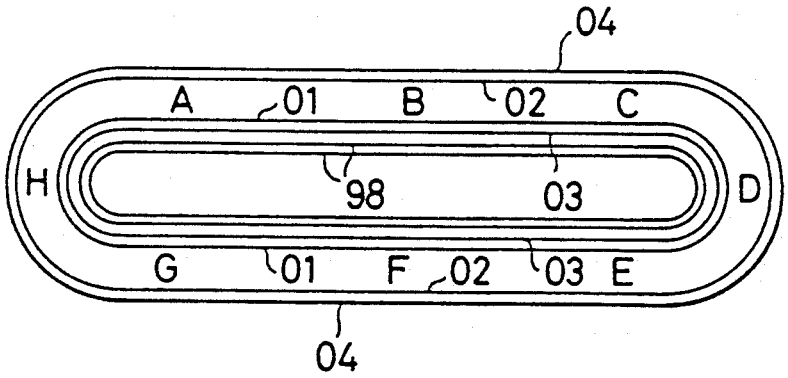
FIG. 13 is a schematic plan view of the escalator shown in FIG. 12.
Figure 14:
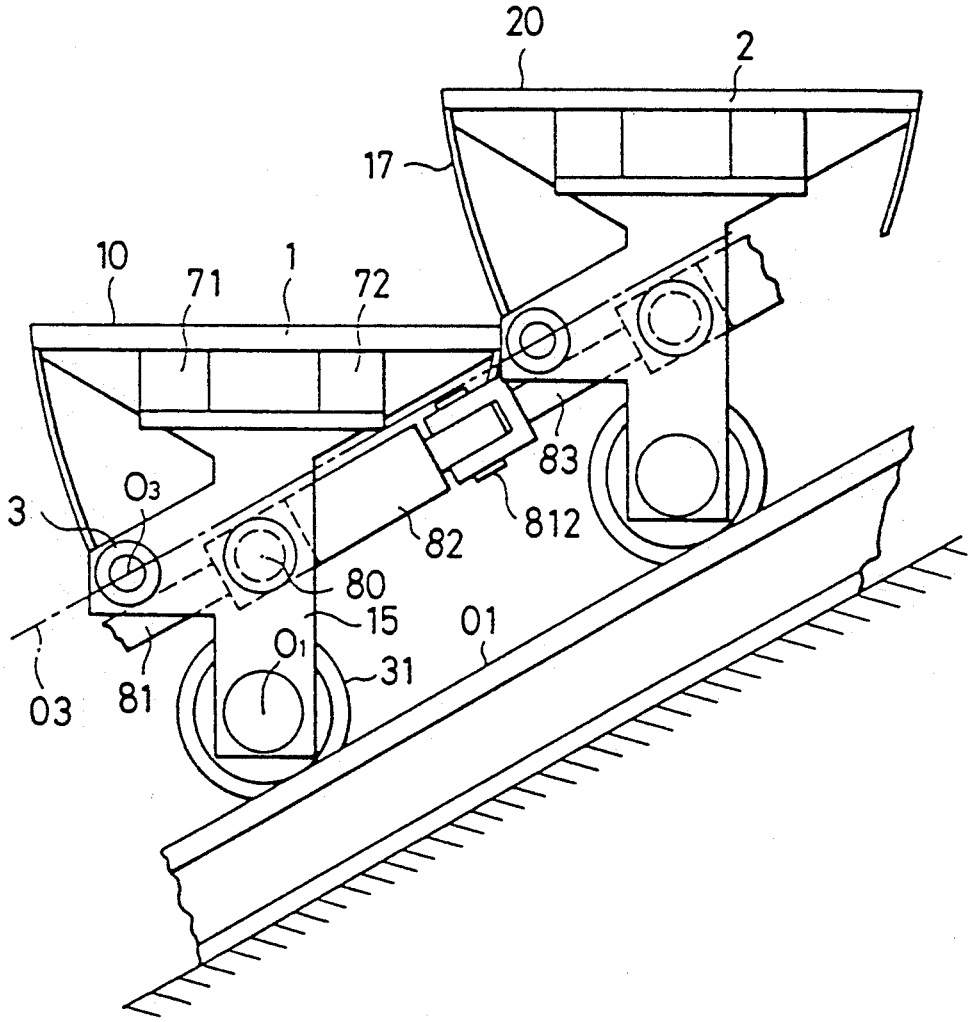
FIG. 14 is a side view showing steps in an ascending traveling section.
Figure 15:
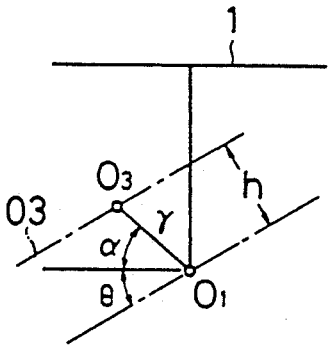
FIG. 15 is a view showing a relationship between a step and a main guide rail in the ascent section.
Figure 16:
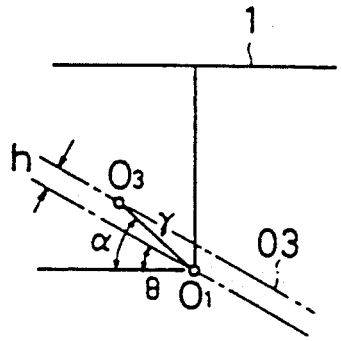
FIG. 16 is a view, similar to FIG. 15, associated with a descending traveling section.
Figure 17:
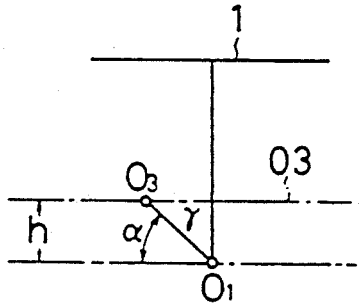
FIG. 17 is a view, similar to FIG. 15, associated with a forward horizontal traveling section.
Figure 18:
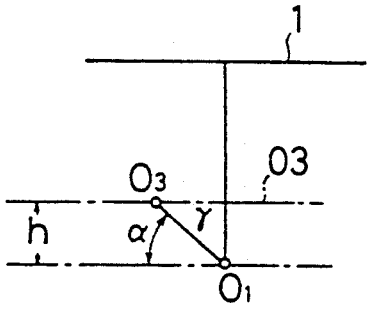
FIG. 18 is a view, similar to FIG. 15, associated with a backward horizontal traveling section.
Figure 20:
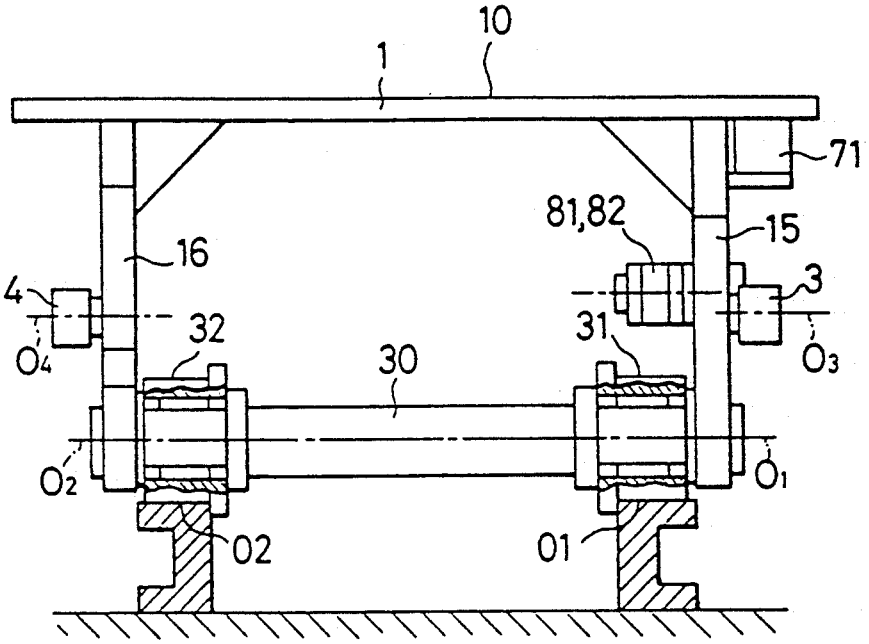
FIG. 20 is a front view showing a step in the horizontal section.
Figure 20A:
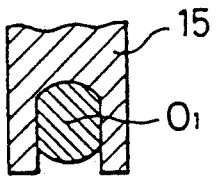
FIG. 20*a* is a fragmentary sectional side view showing a lower end portion of a main column of one step.
Figure 20B:
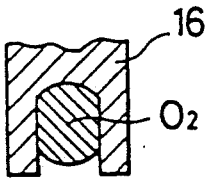
FIG. 20*b* is a view, similar to FIG. 20*a*, showing a lower end portion of an auxiliary column of the step.
Figure 21:
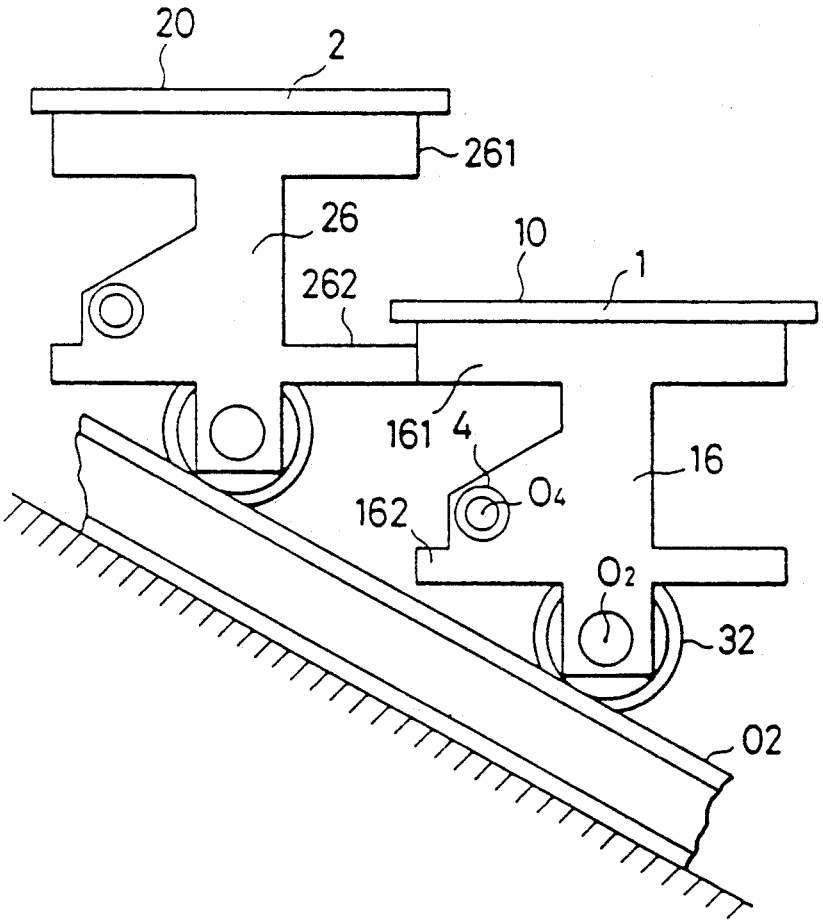
FIG. 21 is a side view showing the auxiliary columns in the ascending traveling section.

The escalator of this embodiment, which is basically the same in construction as the first embodiment, comprises a travel motion path consisting of various traveling sections A–H, and main guide rails 01 and 02 extending along the inner and outer peripheries of the traveling path, and serving to guide step wheels (structural elements illustrated which are the same as those of the first embodiment are shown by the same reference numerals, and explanations thereof will be omitted). Unlike the first embodiment, the escalator of the present invention further comprises auxiliary support pins 3 and 4 (FIG. 20), and auxiliary guide rails 03 and 04 (FIGS. 12 and 13) for guiding these pins. As shown in FIGS. 14, 20 and 21, the auxiliary pin 3 is provided at an outer face of a main column extension part which extends rearwardly from a main column 15 of the step concerned, whereas the auxiliary support pin 4 is provided at an outer face of an auxiliary column extension part which extends forwardly from an auxiliary column 16 of the step. From the view point of improving appearance and safeness, preferably, locations at which the auxiliary support pins 3 and 4 are provided are properly selected such that the auxiliary guide rails 03 and 04 disposed opposite these pins are not exposed to the outside over the whole of the travel motion path. Reference numerals $O_1$ and $O_2$ represent the centers of the wheels 31 and 32, and $O_3$ and $O_4$ represent the centers of the auxiliary support pins 3 and 4, respectively.

Figure 12:
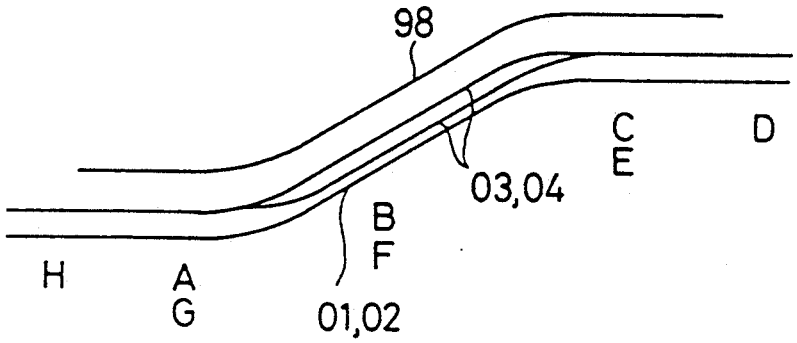
FIG. 12 is a schematic side view showing a travel motion path of an escalator according to a second embodiment of the present invention, together with guide rails for steps and for a moving handrail.

As shown in FIG. 12, the auxiliary guide rail 03 is disposed at the same vertical level as the main guide rail 01 in the horizontal traveling section, and is disposed at a level higher than the level of the main guide rail 98 in intermediate portions of the ascent and descent traveling sections. Further, the auxiliary guide rail is so disposed that the level difference between the main and auxiliary guide rails is gradually increased in a transient part from the horizontal section to the ascent or descent section. The auxiliary guide rail 04 is arranged in a manner similar to the auxiliary guide rail 03.

Figure 19:
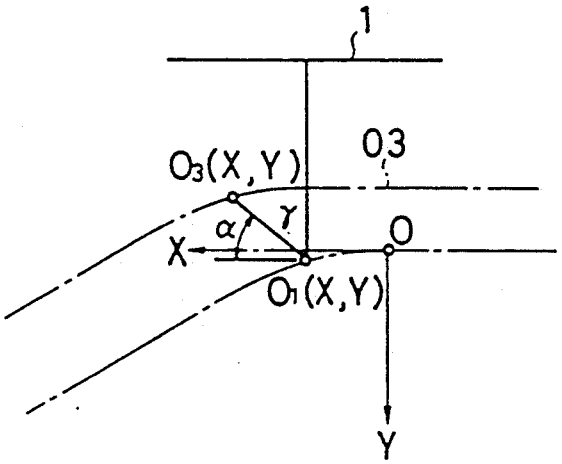
FIG. 19 is a view showing a relationship between a step and the main guide rail at a boundary between the ascent section and the horizontal section.

More specifically, the auxiliary guide rail 03 is provided in such a manner that the distance h between a moving locus of the center $O_1$ of the wheel 31 and that of the center $O_3$ of the auxiliary support pin 3 fulfills the following formulae (1) to (3) in the ascent and descent sections (oblique sections) B and F and the horizontal section (see, FIGS. 15 through 18). Moreover, the auxiliary guide rail 03 is installed along a predetermined relaxation curve at a boundary part between the horizontal and oblique sections. For instance, in the transient part from the ascent section B and the horizontal section C, the auxiliary guide rail is provided such that the relationship represented by the following formulae (4) and (5) are fulfilled between the locus (X, Y) of the pin center $O_3$ and the locus (x, y) of the wheel center $O_1$ (see, FIG. 19). Although an explanation is omitted here, the auxiliary guide rail 04 is provided in a similar manner.

$$h = r \cdot \sin(\alpha + \theta) \quad (1)$$

$$h = r \cdot \sin(\alpha - \theta) \quad (2)$$

$$h = r \cdot \sin \alpha \quad (3)$$

$$X = x + r \cdot \cos \alpha \quad (4)$$

$$Y = y - r \cdot \sin \alpha \quad (5)$$

where symbol r represents the length of the straight line $\overline{O_1O_3}$ connecting the wheel center $O_1$ with the auxiliary support pin center $O_3$; $\alpha$, the angle formed between the straight line $\overline{O_1O_3}$ and the step face member 10; $\theta$, the inclined angle of the main guide rail 01; x and y, the coordinate position of the wheel center $O_1$ in a rectangular coordinate system; and X and Y, the coordinate position of the auxiliary support pin center $O_3$.

The escalator of this embodiment comprises link mechanisms each coupling associated adjacent steps to each other. Each link mechanism is disposed inside the main columns 15 of the steps, so that a driving force is applied to those parts of the steps which are close to the gravity centers of these steps. For instance, the link mechanism, which couples the step 1 with the step 2, has horizontal pins 80 provided at the main columns 15 of these steps and extending perpendicular to the step traveling direction, a link consisting of a pair of link halves 82 and 83, and a pin 812 extending perpendicularly to the link axis, as shown in FIG. 14. Each link half has one end portion thereof formed into a fork, and the other end portion thereof formed into a single tongue which is twisted by 90 degrees relative to the one end portion, these end portions being respectively formed with holes. The forked end portion of the link half 82 is coupled to the horizontal pin 80 of the step 1 together with the single tongued end portion of the other link half 81, whereas the forked end portion of a link half 83 whose single tongued end portion is coupled to the horizontal pin 80 of the step 2, and the single tongued end portion of the link half 82 are coupled to the pin 812.

Accordingly, the link is lockable around the horizontal axis perpendicular to the step traveling direction, and is bendable at its intermediate portion around the vertical axis perpendicular to the step traveling direction and the horizontal axis. As a result, in the transient part between the horizontal and oblique sections in which the inclination of the main and auxiliary guide rails gradually changes, the adjacent steps are swung separately and independently from each other relative to the link which connects these steps with each other. Thus, the wheel and auxiliary support pin of each step appropriately follow the main and auxiliary guide rails, respectively. Moreover, in the turning section, the adjacent steps are movable in different directions. Hence, these steps are enabled to smoothly travel along the U-shaped main and auxiliary guide rails.

As in the first embodiment, in order to ensure that the adjacent steps 1 and 2 are kept abutted to each other during their oblique travel motion, these steps are provided with upper protuberances 161, 261 and lower protuberances 162, 262 (FIG. 21), so that the lower protuberance of one of the steps which assumes a higher vertical level abuts the upper protuberance of the other step during the oblique traveling. Further, during the horizontal traveling, opposed end surfaces of step face members of the adjacent steps are in contact with each other. Moreover, an inner portion of each step is obliquely cut off, so that the step assumes its appropriate orientation during the turning travel motion, without causing interference between adjacent steps.

Next, with reference to FIG. 22, an escalator according to a third embodiment of the present invention will be explained.

The present embodiment contemplates to providing a reciprocal escalator which has the total width of approximately 1,200 mm including the width of a moving handrail, and which permits passengers to stand stably thereon. To this end, the escalator shown in FIG. 22 is so designed that each passenger 0 stands thereon, with one leg on a step 1 and the other leg on a step 2, while looking in the direction extending at an angle $\alpha'$ relative to the step traveling direction, unlike the conventional escalator wherein each passenger stands, with both legs on a single step, while looking in the step traveling direction.

More specifically, one of adjacent steps, e.g., the step 1, has a step face member which is provided at one side thereof with a stepped portion 100 permitting a passenger to place his or her one leg thereon, in an oblique section. If necessary, a narrow stepped portion 200 permitting goods to be placed thereon is provided at one side of the step face member of the other of the adjacent steps, e.g., the step 2. In a horizontal section, a passenger stands, with both legs on the step face member of the step 2. In the oblique section, the passenger stands, with both legs on the step face member of the step 2 and the upper face of the stepped portion 100 of the step 1, respectively. The height S of the stepped portion is set to a value equal to the level difference S between the adjacent steps 1 and 2 in the oblique section, so that the upper face of the stepped portion 100 of the step 1 assumes the same vertical level as the step face member of the step 2, in the oblique section. Reference numeral 500 represents the moving handrail.

From the view point of making the escalator compact in size, the width A' of the step is set to a value ranging approximately from 300 mm to 450 mm, and its length B' is set to a value ranging approximately from 200 mm to 300 mm, so as to reduce the area of the step face member to approximately half of that of an ordinary one-passenger type escalator. Further, both of the width C' and length D' of the stepped portion 100 are set to approximately 200 mm. In the case of the escalator whose inclined angle $\theta$ is 30 degrees and whose step length B' is 250 mm, the height S of the stepped portion 100 is set to 125 mm. The width E' of the stepped portion 200 for goods is set to a value less than 200 mm (illustrated one has its width of 100 mm), its length F' is set to approximately 200 mm, and its height S is set to 125 mm, for instance.

Figure 22:
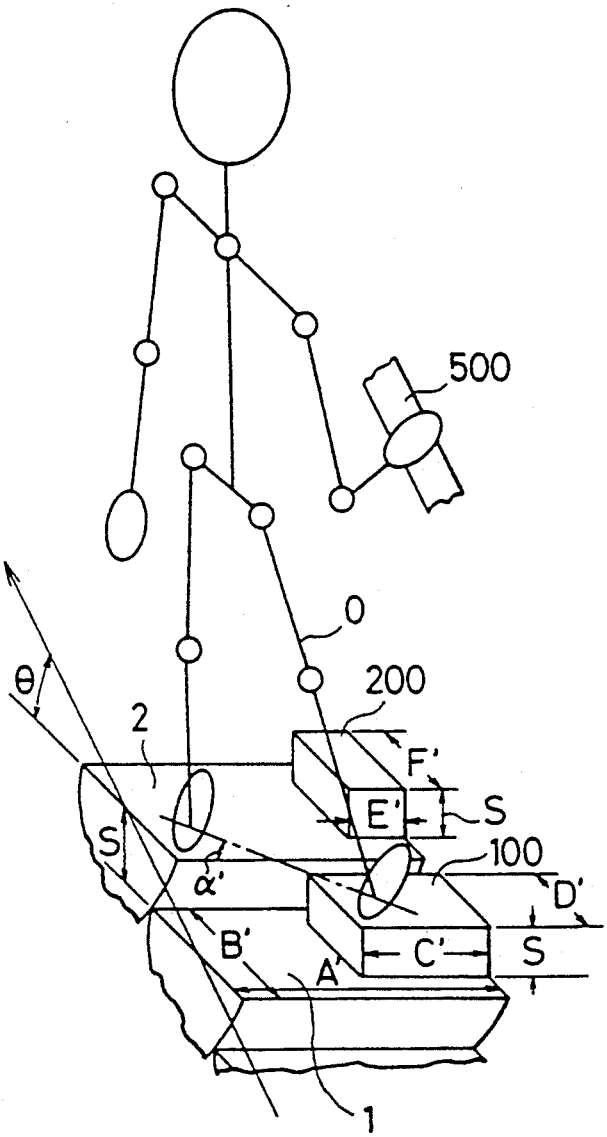
FIG. 22 is a fragmentary perspective view showing an escalator for a narrow passage according to a third embodiment of the present invention.

The other arrangements of the escalator shown in FIG. 22 are similar to those of the first embodiment, and hence explanations thereof will be omitted.

The present invention is not limited to the first through third embodiments, and may be modified in various manners.

For instance, two or more drive mechanisms may be provided and synchronously operated, if the travel motion path is long or if the ascent section is separated from the descent section.

Figure 3B:
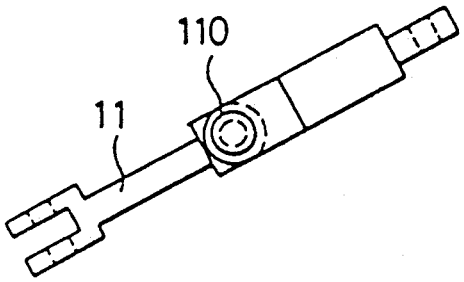
FIG. 3*b* is a plan view showing a modification of a coupling node shown in FIG. 3.
Figure 3C:
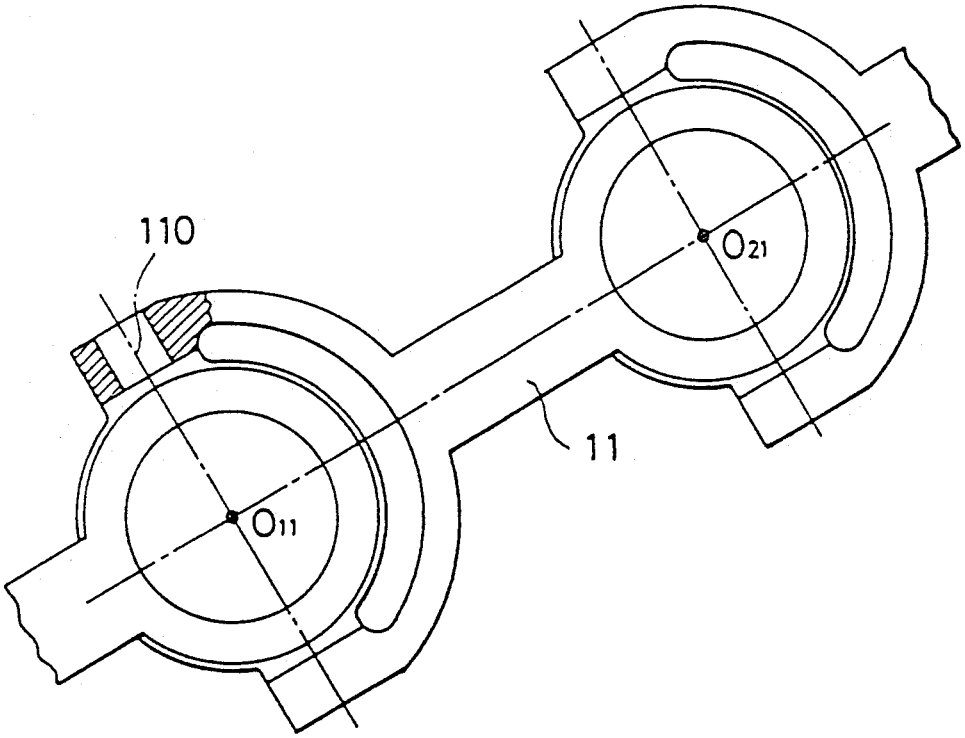
FIG. 3*c* is a fragmentary enlarged side view showing another modification of the coupling node.

The link half shown in FIG. 3*b* may be coupled to the same link half by means of the pin 110 or 120, to thereby obtain the coupling node 11 or 12. The link half shown in FIG. 3*b* has one end portion thereof (left end portion in the figure) formed into a fork, and the other end thereof formed into a single tongue twisted by 90 degrees relative to its one end. By combining the link halves which have the same construction and size in this manner, kinds of components can be reduced by half, and is hence advantageous in production. Meanwhile, it is not inevitably necessary to arrange the axis of the pin, which permits the coupling node to be bendable, to pass through the center of the coupling node. Alternatively, the pin axis may pass through a pin node point of the coupling node, as shown in FIG. 3*c*. In this case, adjacent pin node points are connected by one of rigid links. An explanation as to a formula representing the radius r of a pitch circle of a gear when such a rigid link is employed is omitted here although this formula is different from the aforementioned formula.

A drive mechanism of a type different from the aforementioned drive mechanism may be provided together with the latter mechanism, so as to obtain ensured or strengthened drive. For instance, a rack and pinion mechanism may be provided in the horizontal or oblique traveling section. In this case, a phase difference among the racks provided in the respective steps should be eliminated, and at the same time, a pitch with which the steps are positioned should be differentiated from a pitch with which pinion shafts are positioned, to thereby prevent engagement/disengagement between the rack and the pinion from being established simultaneously at plural steps.

Figure 11:
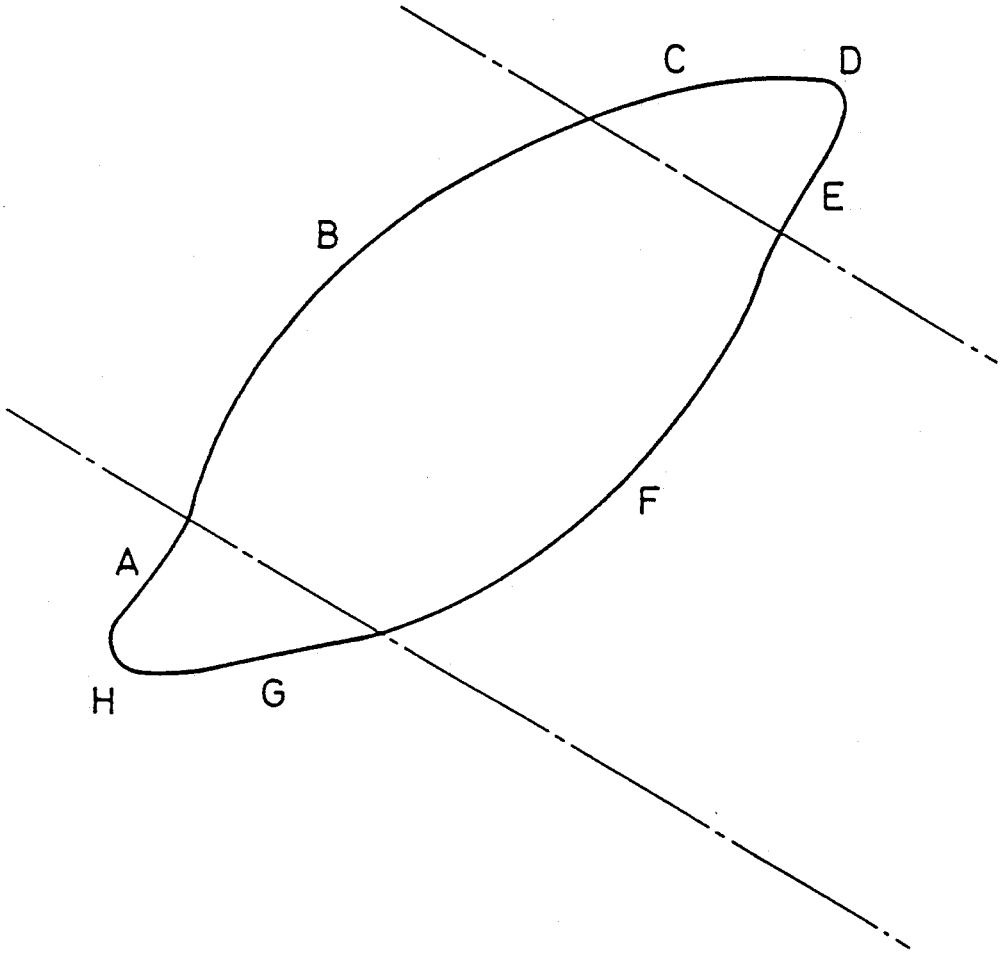
FIG. 11 is a schematic plane view showing, by way of example, a travel motion path of a curved escalator as a modification of the escalator of the first embodiment.

According to the present invention, the steps are movable along the travel motion path, irrespective of whether the travel motion path is horizontal or inclined, or whether straight or curved. In other words, various types of travel motion path can be freely designed. Thus, as exemplarily shown in FIG. 11, an escalator can be achieved, which has the travel motion path comprised of various curved sections. In this manner, the conveyer machine of the invention is highly applicable to various fields. The conveyer machine with decorative elements may be installed in leisure facilities, etc. In applying the conveyer machine to a moving pavement, no difficulties due to the presence of slopes and curves will occur, so that this application can be realized under various conditions. Moreover, in the application to a goods-assorting works in terminals, the travel motion path suitable to good-assorting operations can be provided to improve operation efficiency.

As compared with conventional escalators, the conveyer machine of the present invention has a small vertical depth and is light in weight. Thus, the conveyer machine can be installed simple simply using a slight modification of an existing staircase. Further, the conveyer machine can be installed along a halfpace of a staircase for reduction of the oblique section length, whereby fear of passengers at oblique section can be reduced.

I claim:

1. A conveyer machine comprising:

a travel motion path including a forward section and a backward section which are continuous with each other through a turning section;

a plurality of steps disposed on the travel motion path and each having a step face member;

link means each coupling a corresponding pair of steps to each other;

means for maintaining the step face member of each step horizontal; and a drive mechanism for driving the plurality of steps, each link means being bendable around a first axis perpendicular to a traveling direction of an associated one pair of steps and around a second axis perpendicular to both the step traveling direction and the first axis, wherein each of said steps has a column extending vertically downwardly from said step face member, said link means including a parallel link mechanism which has a pair of first pins and a pair of second pins respectively provided in a corresponding one pair of columns, a first link having opposite ends thereof coupled to said pair of first pins, and a second link having opposite ends thereof coupled to said pair of second pins, each of said first and second links being bendable at its intermediate portion around an axis perpendicular to an axis of each link, an axis of each of said pair of first pins and said pair of second pins extending perpendicular to a straight traveling direction of one pair of steps associated with said first and second pins and perpendicular to the axis of each of the first and second links, and wherein each of said first and second links has a first link half, a second link half, and a third pin, each link half having opposite ends thereof coupled to said third pin and a corresponding one of said pair of first pins and said pair of second pins, said third pin having its axis extending perpendicular to the axis of a corresponding one of the links.

2. A conveyer machine according to claim 1, wherein said travel motion path includes a guide rail which extends along said travel motion path, and on which said plurality of steps is disposed.

3. A conveyer machine according to claim 2, wherein said plurality of steps is disposed on said guide rail such that the steps are close to one another.

4. A conveyer machine according to claim 1, wherein said means for maintaining said step face members horizontal includes a guide rail which extends along said travel motion path and operates to guide each of said steps, a vertical level of said guide rail being set such that said step face member of each step is always maintained horizontal.

5. A conveyer machine according to claim 1, wherein one of said forward and backward sections includes an ascent section, and the other section includes a descent section.

6. A conveyer machine according to claim 1, wherein said travel motion path includes first and second turning sections, one of said forward and backward sections including a first horizontal section which is continuous with said first turning section, an ascent section which is continuous with said first horizontal section, and a second horizontal section which is continuous at upstream and downstream sides thereof with said ascent section and said second turning section, respectively, the other of said forward and backward sections including a third horizontal section which is continuous with said second turning section, a descent section which is continuous with said third horizontal section, and a fourth horizontal section which is continuous at upstream and downstream sides thereof with said descent section and said first turning section, respectively.

7. A conveyer machine according to claim 6, wherein said first and second turning sections are disposed horizontally.

8. A conveyer machine according to claim 6, wherein said travel motion path includes a first guide rail which extends along said travel motion path and on which said plurality of steps is disposed, said means for maintaining said step face members horizontal including a second guide rail which extends along said travel motion path and operates to guide said steps, said first and second guide rails being disposed such that a difference between vertical levels of said first and second guide rails in said ascent and descent sections is larger than the vertical level difference in each of said horizontal sections.

9. A conveyer machine according to claim 8, wherein said first and second guide rails are disposed such that said vertical level difference between said first and second guide rails is equal to a first predetermined value in each of said horizontal sections, is equal to a second predetermined value in said ascent section, said second predetermined value being larger than the first predetermined value, and is equal to a third predetermined value in said descent section, said third predetermined value being larger than said first predetermined value and less than said second predetermined value.

10. A conveyer machine according to claim 8, wherein the vertical level of said second guide rail is varied along a relaxation curve at a boundary portion between each of said ascent and descent sections and an adjacent one of said horizontal sections.

11. A conveyer machine according to claim 1, further comprising:

a moving handrail which has a plurality of handrail units, a plurality of couplings, each coupling associated with adjacent ones of said plurality of handrail units, and guide means disposed along said travel motion path for guiding said plurality of handrail units, each of said couplings being bendable around two axes which extend perpendicular to each other and each of which extends perpendicular to a straight travel direction of the steps.

12. A conveyer machine according to claim 11, further including:

a handrail drive mechanism for moving said plurality of handrail units along said guide means, each of said handrail units having teeth, said handrail drive mechanism having a gear which is in mesh with the teeth of each handrail unit, and causing, through said gear, said moving handrail to move in synchronism with the travel of said plurality of steps.

13. A conveyer machine comprising:

a travel motion path including a forward section and a backward section which are continuous with each other through a turning section;

a plurality of steps disposed on the travel motion path and each having a step face member;

link means, each coupling a corresponding pair of steps to each other;

means for maintaining the step face of each step horizontal; and a drive mechanism for driving the plurality of steps, each link means being bendable around a first axis perpendicular to a traveling direction of an associated one pair of steps and around a second axis perpendicular to both the step traveling direction and the first axis;

wherein one of said forward and backward sections includes an ascent section, and the other section includes a descent section, each of said steps having a main column which extends downwardly from one side of the step face member and supports a corresponding one of said plurality of link means, and an auxiliary column which extends downwardly from another side of the step face member, said auxiliary column of each step having upper and lower protuberances which are vertically separated from each other and which extend horizontally, the upper protuberance of one of adjacent steps abutting the lower protuberance of the other step in said ascent and descent sections.

14. A conveyer machine according to claim 1, wherein each of said steps has its width set to a value equal to or less than 450 mm, and its length set to a value equal to or less than 300 mm.

15. A conveyer machine according to claim 14, wherein one of said forward and backward sections includes an ascent section, and the other section includes a descent section, a stepped portion being provided at every two step face members of said plurality of steps, said stepped portion having its height set to a value equal to a height difference between adjacent steps in said ascent and descent sections, whereby a passenger is enabled to stand, with both legs on said step face member of one of the adjacent steps and on an upper face of said stepped portion of the other step, respectively, while looking in a direction obliquely extending relative to a traveling direction of these steps.

16. A conveyer machine according to claim 1, further comprising:

an expansion and contraction joint mechanism for adjusting a travel motion path length.

* * * * *